United States Patent [19]

Segura

[11] Patent Number: 4,480,363

[45] Date of Patent: Nov. 6, 1984

[54] NAPPING APPARATUS FOR TEXTILE MATERIAL

[76] Inventor: Dionisio T. Segura, Joaquin Blume num. 4, Sabadell (Barcelona), Spain

[21] Appl. No.: 97,872

[22] Filed: Nov. 27, 1979

[30] Foreign Application Priority Data

Nov. 27, 1978 [ES] Spain ..... 475.450

[51] Int. Cl.[3] ..... D06C 11/00

[52] U.S. Cl. ..... 26/29 R

[58] Field of Search ..... 26/29 R, 36

[56] References Cited

U.S. PATENT DOCUMENTS

| | | | |
|---|---|---|---|
| 1,017,151 | 2/1912 | Jamieson | 26/29 R |
| 2,698,476 | 1/1955 | Hadley | 26/29 R |
| 2,716,797 | 9/1955 | Hadley | 26/29 R |
| 2,749,593 | 6/1956 | Hadley | 26/29 R |
| 3,153,836 | 10/1964 | Hadley | 26/29 R |
| 3,373,468 | 3/1968 | Mullers | 26/29 R |

FOREIGN PATENT DOCUMENTS

| | | | |
|---|---|---|---|
| 9887 | of 1896 | United Kingdom | 26/29 R |
| 2036116 | 6/1980 | United Kingdom | 26/29 R |

*Primary Examiner*—Robert Mackey
*Attorney, Agent, or Firm*—Michael J. Striker

[57] ABSTRACT

An apparatus for napping a textile material includes a plurality of rollers for advancing the material to be napped in continual longitudinal movement and a plurality of napping rollers arranged in contact with the material to be napped and adapted for rotational movement. The napping rollers includes one group of napping rollers arranged in contact with one side of the material and a second group of napping rollers arranged in contact with the opposite side of the material. The rollers for advancing the material and the napping rollers are operatively connected to each other. A drive for generating the movement of the material and rotation of the napping rollers is provided in the apparatus. A device for varying a speed and direction of the movement of the napping rollers to provide alternate oscillating movement thereof is arranged in the apparatus. The speed-varying device is connected to the drive to provide a periodical swaying movement of the material to be napped simultaneously with alternate oscillating movement of the napping rollers.

6 Claims, 2 Drawing Figures

NAPPING APPARATUS FOR TEXTILE MATERIAL

BACKGROUND OF THE INVENTION

The invention pertains to an operation known as napping, which has been commonly practiced for a long time in the textile industry. Its purpose is to make some of the fibers which form a cloth extend outwardly from the face of the cloth by means of repeated brushing on one or both sides of the cloth with suitable prongs, so that a fibrous upstanding layer is formed. The napped product has many applications and may be used industrially, or where a decorative or comfortable cloth is required, and even be used to simulate fine furs.

The above mentioned napping operation, originally carried out manually by scratching the cloth with certain dry vegetable thistles, is now carried out with cylinder napping machines, called simply nappers. These machines have a large horizontal rotating drum, on the circumference of which a plurality of satellite cylinders are located, each cylinder being equipped with prongs of steel wire.

In view of the fact that the structure, the operating principles and handling of these machines are well known for more than a century in the textile industry, they will not be discussed in detail. Those unique characteristics will be the only ones mentioned here, which are considered helpful for a greater understanding and clarification of the invention which is object of the present application.

In most napping operations, the object is to form upon the cloth a soft, thick outer layer of the fibers. A typical example of this is found in the manufacture of blankets. In order to obtain such a result, it has been necessary to submit the cloth to an intense napping, which can only be achieved from accumulation, by repeatedly passing the cloth through the machine. The effect can be improved considerably if, after each passing of the cloth through the machine, the direction in which a piece of cloth is passed through the machine is reversed, so that what was once the head of the piece becomes the tail thereof for the next passing step and vice versa, and the strip of cloth—the source of the fibers to be extracted—receives the attack of the prongs from opposite directions, alternately.

This technique is imposed by the nature of the napping machine with cylinders and has been supported by many years in practice. It, however, involves certain limitations and inconveniences which until now have been accepted as inevitable. For example, the repetition of the passing of the cloth through the machine turns out to be expensive in time, energy and labour. Also, the increase in the napping effect due to the repetition of passages has a limit, for each new passage makes it more difficult for the prongs to penetrate the raised layer of fibers generated from the preceding passage, namely fibers which are now flattened by the intermediary piles of cloth. The prongs scarcely manage to extract new fibers from the strip of cloth which remains at the bottom of the layer, but each time they tear out and remove the layer instead of enriching it. When the cloth is to be napped on both sides, these inconveniences are repeated on the second side and experience shows that generally the finishing of the second side is different from that of the first one.

It should be noted that it is not always advisable to decrease the number of passages by means of increasing the number of napping cylinders, since there are certain known physical and mechanical limitations which prevent it and the practice has shown the inefficiency of such a solution. The energy of the napping cylinders in the machine cannot be increased beyond what the resistance of the cloth being processed will permit. And it should also be pointed out in this sense that the resistance of the cloth is not only tested by the napping cylinders, but also mainly when it is removed from the drum at the end of the passage. At this point, the cloth, which bears some very small difference in speeds with regard to the prongs of the satellite cylinders, is subjected brusquely to a difference of speeds with regard to the drum. In addition, the cloth is usually removed perpendicularly of the drum and sometimes in a direction opposite to that of the rotation of the napping drum.

SUMMARY OF THE INVENTION

According to the present invention there is provided a napping machine comprising: a frame; a plurality of rotable napping means, the axes of which are fixed with respect to the frame; means for drawing the cloth longitudinally past said napping means to nap the cloth; and means for imparting a longitudinal reciprocal motion to a portion of the cloth adjacent said napping means so that said portion is moved sequentially in two opposite longitudinal directions as it passes said napping means; the machine being characterized in that, in any given speed of the cloth with respect to the frame, each napping means rotates with a respective peripheral tangential speed (measured adjacent the cloth, in the same direction as the motion of the cloth, and relative to the frame), which is proportional to the speed of the cloth relative to the frame, there being a first constant of proportionality when the cloth moves in a first direction and a second constant of proportionality when the cloth is moving in the second direction, opposite to the first one.

Preferably, said napping means comprises at least two napping cylinders, each of which has on its circumference an array of curved prongs.

Conveniently at any given moment during a reciprocal motion of the cloth, at least one napping cylinder, namely an advancing cylinder, has a tangential speed that is greater than the speed of the cloth, and at least one other napping cylinder, namely a retarding cylinder, has a tangential speed that is less than the speed of the cloth.

Advantageously the prongs of the or each advancing cylinder can be curved in the direction of motion of the cloth and the prongs of the retarding cylinder can be curved in the opposite direction to the motion of the cloth.

DETAILED DESCRIPTION OF THE INVENTION

Figure 1:
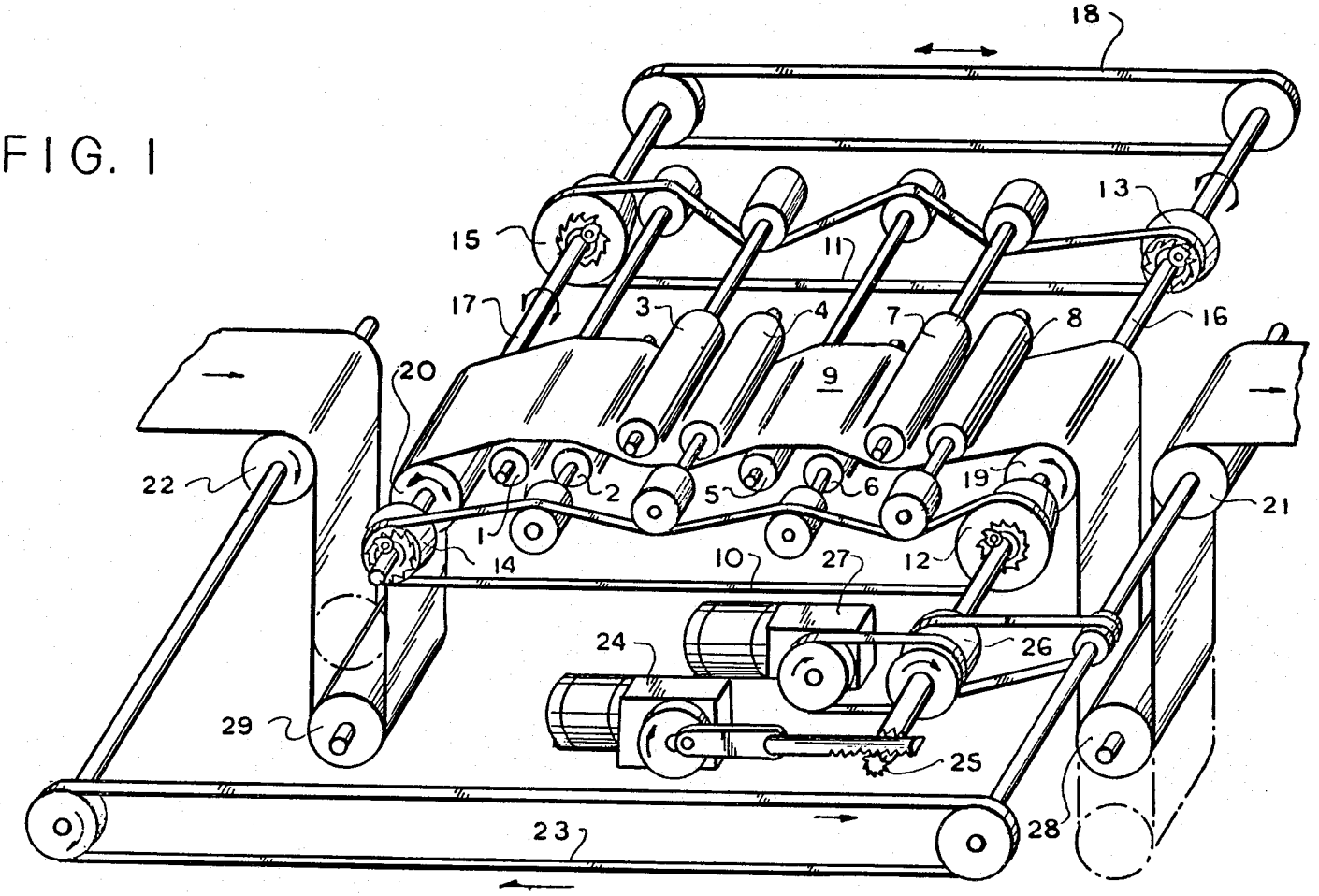
FIG. 1 is a diagrammatic view of the apparatus for napping a textile material in accordance with the present invention.

In FIG. 1, the cylinders (1), (3), (5) and (7) are napping cylinders with their prongs pointed in the same direction. Cylinders (2), (4), (6) and (8) are also napping cylinders having their prongs oriented in the same direction which is, opposite to that of the prongs of the napping cylinders (1), (3), (5) and (7). A cloth (9) is placed between both sets of napping cylinders and is in contact with all of them. All napping cylinders have the same diameter and their relative position is such as to assure an ideal arch of contact with the cloth (9).

An endless belt (10) extends between two frusto-conical pulleys (12) and (14), firmly contacting all four pulleys fixed to the axes of the napping cylinders (2), (4), (6) and (8).

An endless belt (11) extends between two frusto-conical pulleys (13) and (15), firmly contacting all four pulleys fixed to the axes of the napping cylinders (1), (3), (5) and (7).

The pulleys for rotating the napping cylinders have the same diameter as the napping cylinders.

The frusto-conical pulleys (12), (13), (14) and (15) form part of a varying speed device for the regulation of the napping cylinders. All four frusto-conical pulleys (12), (13), (14) and (15) have a respective ratchet mechanism interposed between the inside of the pulley and the respective axle. The ratchets associated with the pulleys (12) and (14) are adapted so that the pulleys are driven when the axles (16) and (17) both rotate in one direction, namely the counter-clockwise direction when the apparatus is considered in the orientation of FIG. 1. The ratchets associated with the pulleys (13) and (15) are adapted so that the pulleys are driven when the axles (16) and (17) both rotate in the opposite direction, namely the clockwise direction when the apparatus is considered in the orientation of FIG. 1. Each axle (16) and (17) is provided at one end thereof with a pulley which is securely fixed on the respective axle for rotation, by means of endless belt (18). Axles (16) and (17), always rotate, at any instant, in the same direction and at the same speed.

For greater clarity, the screws, which are conventional for all the varying devices of frusto-conical pulleys, are not shown in the drawings. Their mission is to displace the belt on the pulley in order to change its speed.

The cylinders (19) and (20) are fixed securely to the respective axles (16) and (17). The relation between greater or smaller diameters of the frusto-conical pulleys (12), (13), (14) and (15) and the diameter of the cylinders (19) and (20) are the following: indicating as D the diameter of these cylinders, for the frusto-conical pulleys (12) and (15), the greater diameter is larger than D and the lesser one is equal to D; for the frusto-conical pulleys (13) and (14), the greater diameter is equal to D and the lesser one is smaller than D.

Figure 2:
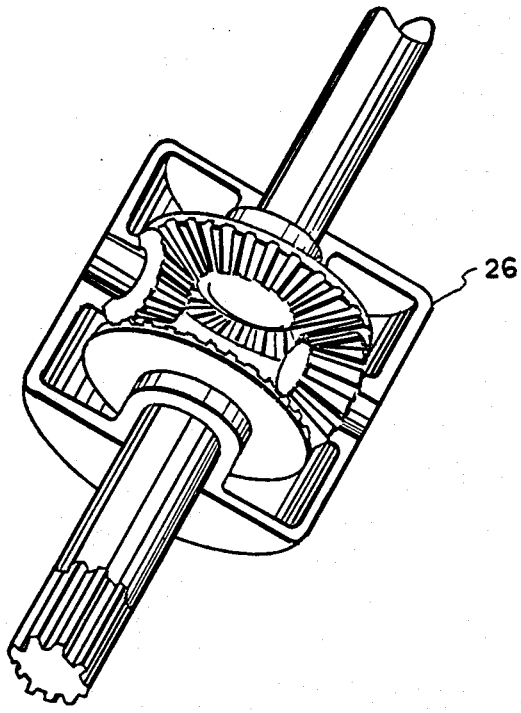
FIG. 2 is a partial sectional view showing a structure of a differential utilized in the arrangement shown in FIG. 1.

The axle (16) is connected to a differential gear mechanism (26) as shown in FIG. 2, which is that of the coaxial type with planetary pinions similar to those used in an automobile. Its operation is not covered in detail, because it is known in the art.

An endless belt passes around the exterior of the satellite box of the differential mechanism (26) to a driving motor (27), which, in operation of the apparatus, drives the satellite box at a substantially constant rate.

A further belt also extends around the exterior of the differential mechanism (26) so as to impart that rotary motion of the satellite box of the differential mechanism (26) to the drive roller (21). At the end furthest from the drive roller (21) is a further pulley. There is also a pulley firmly mounted at one end of the axle supporting the drive roller (22). The endless belt (23) extends around these pulleys so that drive rollers (21) and (22) are, at any instant, driven in the same direction and at the same speed.

The end of a shaft connected to the side of the differential gear that is opposite to the axle (16) forms the pinion of a rack and pinion mechanism (25), the rack of which forms part of an eccentric crank mechanism driven by motor (24).

As a result, the shaft (16), which is the output shaft of the differential box (26), has a motion that is the result of a constant motion provided by the driving motor (27) and an oscillating motion provided by the motor (24) and the rack and pinion mechanism (25).

All the pulleys and drive rollers and drive cylinders are provided with a circumference adapted to prevent or minimize slippage between the pulley, roller or cylinder and the respective belt or piece of cloth.

Cylinders (28) and (29) turn freely and can basculate all along some guides, which are not shown in the figures in order to assure the clarity of them, according to a known compensating device, widely used in textile finishing machinery. Its mission is to absorb and reestablish alternately the periodical excesses of the cloth which is produced in the napping area of the apparatus suggested, according to what will be explained later on.

For greater clarity in the explanation which follows, it is understood that the cloth (9) is advancing from left to the right, according to what appears in FIG. 1.

The operation of the napping apparatus, which is described, is as follows:

The starting of the motor (24) and of the rack and pinion mechanism (25) causes the alternate rotation of the axle (16), in which the cylinder (19) is firmly mounted. The swaying movement is transmitted to cylinder (20) by means of the transmission (18). As a result, the cloth (9) is subjected to incessant movements of advance and reverse, alternately, in the area between cylinders (19) and (20).

When only the driving motor (27) is started, the motion is transmitted to the drive roller (21) and by means of the belt (23) also to the drive roller (22). As the driving motor (27) rotates in the clockwise direction, the cloth (9) moves at a constant speed from (22) and (21).

The simultaneous starting of the driving motor (27) imparts a uniform rotation, in the clockwise direction, at a low speed to the differential box (26). As a result, a constant rotation movement is added to the oscillation of cylinders (19) and (20), which combines with that of the swaying, adding or substracting alternately, according to the directions of both movements. The result is that a regular reversal of the direction of movement of the cloth 9 in the region of the napping cylinders takes place but with the motion to the right as seen in FIG. 1 being faster than the motion to the left, with a result that the net motion of cloth 9 over a period of time is towards the right. The compensating cylinders (28) and (29) act to take up a slack in the cloth 9 and operate to make sure that the cloth advances in a uniform fashion outside the oscillation area.

As illustrated in FIG. 1, the endless belt (11) passes around the larger diameter end of the frusto-conical pulley (15) and around the smaller diameter end of the frusto-conical pulley (13); likewise, the endless belt (10) passes around the smaller diameter end of the frusto-conical pulley (14) and the larger diameter end of the frusto-conical pulley (12). Under these conditions, the napping effect is produced as follows:

At the beginning of a cycle of operation, the cloth (9) is displaced to the right, in the zone adjacent the napping cylinders (1) to (8). The axle (17), the cylinder (20), and, also, because of the arrangement of the respective ratchet, the frusto-conical pulley (15) rotate in the clockwise direction. The consequent clockwise motion of the belt (11) causes napping cylinders (1) and (5) to rotate in the clockwise sense, and correspondingly the napping cylinders (3) and (7) rotate in the counterclockwise sense. Thus all four napping cylinders rotate in the direction of hook inclination, and in the direction of the cloth movement. Because of the location of the napping cylinders relative to the cloth (9), and because of the direction of curvature of the steel prongs on the circumference of the napping cylinders, the effect of the napping cylinders (1), (3), (5) and (7) is to urge the cloth (9) towards the right of FIG. 1. However, the ratio of the diameter of the pulleys associated to these napping cylinders to the larger diameter of the frusto-conical pulley (15) is such that the prongs of the napping cylinders (1), (3), (5) and (7) touching the cloth have a higher instantaneous speed than does the cloth, and thus the prongs operate on the cloth (9) to raise fibers. The motion of the belt (11) causes the frusto-conical pulley (13) to rotate in the clockwise direction but, since the belt (11) engages the smaller diameter portion of the pulley (13), said pulley rotates at a higher speed than does the axle (16), and thus the respective ratchet free wheels.

Simultaneously, the motion of the cloth (9) causes the napping cylinders (2), (4), (6) and (8) to rotate, and hence the endless belt (10) is also set into motion. However, the speed of the belt (10) is limited since the belt passes around the frusto-conical pulley (14) which cannot, because of the associated ratchet mechanism, rotate any quicker than the axle (17). The effect of this is to limit the speed of the rotation of the napping cylinders (2), (4), (6) and (8) thus causing a napping action similar to that described above, which assists in raising fibers. It is to be noted that fibers raised by the napping cylinders (1), (3), (5) and (7) are directed towards the right hand side of FIG. 1, while fibers raised by the napping cylinders (2), (4), (6) and (8) are directed towards the left. Because the endless belt (10) passes around the larger diameter of the frusto-conical pulley (12), this pulley rotates slower than the axle (16) and hence the ratchet mechanism merely slips and the pulley (12) and the axle (16) are not in a driving connection.

During the next part of the cycle of operation, the action of the differential box (26) is such that the cloth (9) in the region of the napping cylinders (1) to (8) moves to the left. The axle (16) is now turning in the counterclockwise direction, causing the pawl of the appropriate ratchet mechanism to turn the frusto-conical pulley (12) in an counterclockwise direction. The belt (10) transmits the rotary motion to the napping cylinders (2), (4), (6) and (8) in a manner corresponding to that described above so that cylinders (2) and (6) rotate counterclockwise and cylinders (4) and (8) rotate clockwise. Thus, the cylinders all rotate in the direction of the cloth movement. The prongs on the napping cylinders (2), (4), (6) and (8) raise fibers on the cloth in the leftward direction. The ratchet mechanism of the frusto-conical pulley (14) slips and rotates faster than the shaft (17). The cloth, moving in the leftward direction, engages the prongs of the napping cylinders (1), (3), (5) and (7) but the rotation of these napping cylinders is limited since the operation of the ratchet mechanism associated with the frusto-conical pulley (13) ensures that pulley (13) cannot rotate faster than axle (16). The fibers are therefore raised to the right.

In summary, each one of the napping cylinders exercises its function alternately, pushing the cloth and being pulled by it. For each napping cylinder, the direction of the napping is that which the prongs face. The cloth receives two effects for napping, introduced in both directions.

It is obvious that the napping effect will depend on the relative speeds of the cloth 9 and the endless belts 10,11 and this relationship is determined by the position of the endless belts on their respective frustoconical pulleys.

Accordingly, the operation of each napping cylinder is such that it alternately pushes the cloth 9 and is pulled by it.

The removal of the cloth from the napping cylinders is carried out tangentially of the napping cylinders. The relationship between the speeds of the cloth and the napping cylinders is selected according to the napping energy applied. This energy can be chosen in dependence on the resistance of the cloth.

Having carefully expressed the characteristics of the invention, it is mentioned that the device which is used to obtain the swaying of the cloth, the activating of the napping cylinders and the control of its effect on the cloth, can be different from those which are explained in the example without changing the nature of the invention.

This procedure is possible in any size and material adequate for the circumstance, and it is susceptible to all kinds of modification of the details, as long as they not alter their fundamental form.

I claim:

1. Napping device for textile material, comprising a bedframe; a set of pairs of turnable spiked napping cylinders, said napping cylinders being so arranged with respect to the textile material that the orientation of the spikes of both cylinders in each pair is opposite to each other; means for drawing textile material longitudinally past the napping cylinders to impart a constant unidirectional motion to the textile material, and means for imparting to the textile material a reciprocal longitudinal movement, so that a portion of the textile material which passes through the napping cylinders moves alternatively in two opposite directions and in such a way that at the delivery of the device, the napping process is completely finished; and means for coordinating the movement of the napping cylinders with the movement of the textile material so that at every instant and for any of the textile material, each of the napping cylinders turns in the same direction as that of the textile material relative to the bedframe and in such a way that at any given moment the napping cylinders which have their spikes oriented in the same direction as the movement of the textile material as seen from a point adjacent to the textile material, have a tangential speed higher than the speed of the textile material and the napping cylinders, the spikes of which are oriented in the direction opposite to the movement of the textile material have a tangential speed lower than the speed of the textile material.

2. The napping device as defined in claim 1, wherein said napping rollers are arranged in pairs relative to the textile material in two parallel planes so that the textile material can be napped on both sides at the same time and in only one cycle.

3. The napping device as defined in claim 1, wherein said imparting means comprises a first electric motor, an eccentric crank connected to said motor, a rack and a pinion mechanism connected to said crank, and a differential gearbox connected to said mechanism, two driving shafts, one of which is connected to an output of said gearbox, two driving cylinders engageable with the textile material and mounted on said two driving shafts, respectively, and a belt transmission connected said two driving shafts to each other.

4. The napping device as defined in claim 3, wherein said drawing means includes a second electric motor and two drive rollers engageable with the textile material and operatively connected to said second electric motor and to said gearbox.

5. The napping device as defined in claim 4, wherein said coordinating means include two pairs of cone pulleys, each pair being mounted on each of said driving shafts at opposite ends thereof, each of said shafts being rigidly connected to the respective driving cylinder, each cone pulley having a ratchet mechanism, each of the napping cylinders having a shaft and a pulley at the ends of said shaft, a first belt transmission means for coupling a cone pulley on one of said driving shafts with a cone pulley on the other of said driving shafts and with the pulleys of the respective napping cylinders, the spikes of which have the same and one orientation; and a second belt transmission means for coupling the other cone pulley on said one of said driving shafts with the other cone pulley on the other of said driving shafts and with the pulleys of the respective napping cylinders, the spikes of which have the same but another orientation opposite to said one orientation.

6. The napping device as defined in claim 5, wherein the ratchet mechanism of one of the cone pulleys of each pair causes the associated cone pulley to rotate rigidly with the respective driving shaft and the ratchet mechanism of the other cone pulley of each pair causes a free rotation of the associated cone pulley on the respective driving shaft when the textile material moves in one direction whereas the one cone pulley of each pair rotates freely on the respective driving shaft and the other cone pulley of each pair rotates rigidly with the respective driving shaft when the textile material moves in the opposite direction.

* * * * *